US007195039B2

(12) United States Patent
Schaich et al.

(10) Patent No.: US 7,195,039 B2
(45) Date of Patent: Mar. 27, 2007

(54) JET WEAVING MACHINE

(75) Inventors: Urs Schaich, Eschenbach (CH); Marius Bachofen, Maennedorf (CH); Erich Gasser, Wiesendangen (CH); Dietmar Markward, Rueti (CH)

(73) Assignee: Sultex AG, Rueti (CH)

( * ) Notice: Subject to any disclaimer, the term of this patent is extended or adjusted under 35 U.S.C. 154(b) by 0 days.

(21) Appl. No.: 10/880,947

(22) Filed: Jun. 29, 2004

(65) Prior Publication Data

US 2005/0034775 A1 Feb. 17, 2005

(30) Foreign Application Priority Data

Aug. 15, 2003 (EP) ..... 03405598
Sep. 17, 2003 (EP) ..... 03405682

(51) Int. Cl.
*D03D 45/04* (2006.01)

(52) U.S. Cl. ..... 139/274; 139/116.1

(58) Field of Classification Search ..... 139/117, 139/116.1, 161.2, 194, 370.2, 273 R, 273 A, 139/274
See application file for complete search history.

(56) References Cited

U.S. PATENT DOCUMENTS 5,226,458 A * 7/1993 Bamelis ..... 139/194
5,606,998 A * 3/1997 Wahhoud et al. ..... 139/194
5,735,316 A * 4/1998 Hehle ..... 139/194
6,082,413 A * 7/2000 Scorl et al. ..... 139/194
6,834,683 B2 * 12/2004 Birner et al. ..... 139/370.2
2005/0034775 A1 * 2/2005 Schaich et al. ..... 139/435.1

FOREIGN PATENT DOCUMENTS

EP 0492745 A1 7/1992
EP 492745 A1 * 7/1992

* cited by examiner

*Primary Examiner*—Gary Welch
*Assistant Examiner*—Andrew W. Sutton
(74) *Attorney, Agent, or Firm*—Townsend and Townsend and Crew LLP; J. Georg Seka; Patrick J. Zhang

(57) ABSTRACT

A jet weaving machine is proposed in which a weft thread (S) can be inserted by means of a fluid from a weft insertion side (2) to a receiving side (3), including a weaving sley (9), along which a weft insertion path (4) extends, which determines a weft insertion direction (A), and including a monitoring apparatus (20) which is arranged at the receiving side (3) and which comprises two sensor devices (21, 22) for detecting the weft thread (S) or parts of the weft thread respectively, with exactly one of the sensor devices (21) being firmly mounted on the weaving sley (9).

16 Claims, 4 Drawing Sheets

JET WEAVING MACHINE

BACKGROUND OF THE INVENTION

The invention relates to a jet weaving machine including a monitoring apparatus for weft threads which is arranged on the receiving side.

In jet weaving machines the weft insertion takes place by means of a fluid, which inserts the respective weft thread from the insertion side through the open shed to the receiving side. In air jet weaving machines this fluid, which serves as a transport medium, is air.

For the weft insertion a definite and predeterminable thread length, which is naturally dependent on the weaving width, is drawn off in each case at the insertion side from the stationary winding drum of a thread supply apparatus and supplied to a main nozzle. The main nozzle is fed with compressed air and accelerates the weft thread into the open shed. Usually a plurality of auxiliary or relay nozzles are provided along the weft insertion path, which are likewise fed with compressed air and guide the weft thread through the shed to the receiving side. After the completion of the weft insertion the leading end of the weft thread is captured and held e.g. by a stretching or capture nozzle and the weft thread is beat up to the cloth by the weaving sley. Then the change of shed takes place, through which the weft thread is bound in over the entire weaving width. Then the thread must be severed on the insertion side between the main nozzle and the cloth edge which is near it in order to be ready for the next weft insertion. On the receiving side the inserted weft thread is likewise severed. The superfluous thread remnant is disposed of by means of a suction or blow off device. After the change of shed the end of the inserted weft thread at the receiving side can then be tucked into the following open shed for example by means of a selvedge tucking apparatus.

To monitor the correct weft insertion it is customary to detect both the arrival of the weft thread, which must take place within a certain time window with respect to the weaving cycle, and to measure the length of the inserted weft thread. If the weft thread does not arrive within the predeterminable time window or if it is detected to be too long, then as a rule corrective measures or even the stopping of the weaving machine are necessary.

In order to monitor both the arrival time as well as the length of the weft thread, sensors, which are designated as weft thread monitors, and which are in each case designed in such a manner that that they can detect the weft thread or the weft thread end respectively, are provided at the receiving side. The first weft thread monitor is usually arranged directly at the end of the weft insertion path on the receiving side. It detects whether or not the weft thread end arrives within the predetermined time window—referred to the weaving cycle. However with this one sensor alone it cannot be tested for example whether the inserted weft thread is too long (long weft thread insertion). Therefore a second weft thread monitor is provided, which is usually arranged in such a manner that the weft thread end does not even reach it in the event of a correct weft thread insertion. In the event of a correct weft thread insertion the weft thread end moves up to a position somewhere between the two weft thread monitors, so that the second sensor gives off no signal.

In known jet weaving machines both weft thread monitors are firmly mounted on the weaving sley so that both execute the oscillatory movement synchronously with the weaving sley. For this it is necessary to guide the weft thread between the first and the second weft thread monitors. A known solution consists in providing an auxiliary reed on the weaving sley as a thread guide for bridging the distance between the two weft thread monitors. Auxiliary nozzles are provided along this auxiliary reed for stretching and/or holding the inserted weft thread.

This construction with the auxiliary reed is however relatively complicated and expensive and takes up space in addition. Furthermore, the auxiliary reed has the disadvantage that it represents an additional mass to be accelerated which executes the same oscillatory movement as the weaving sley.

SUMMARY OF THE INVENTION

Starting from this prior art it is an object of the invention to propose a jet weaving machine which has a receiving side monitoring apparatus for the weft insertion which manages without an auxiliary reed without concessions to the quality of the control of the weft insertion being necessary. Furthermore, it should be possible for the monitoring apparatus to be used for the manipulation and disposal of incorrectly inserted weft threads.

Thus, in accordance with the invention, a jet weaving machine is proposed in which a weft thread can be inserted by means of a fluid from a weft insertion side to a receiving side, including a weaving sley along which a weft insertion path extends, which determines a weft insertion direction, and including a monitoring apparatus which is arranged at the receiving side and which comprises two sensor devices for detecting the weft thread or parts of the weft thread respectively, with exactly one of the sensor devices being fixedly mounted on the weaving sley.

This sensor device, which is fixedly mounted on the weaving sley, will be designated as a weft thread monitor in the following. Since only one of the sensor devices, namely the weft thread monitor, is still mounted on the weaving sley at the receiving side end of the weft insertion path, and since the other sensor device is no longer provided on the weaving sley, there is no longer any need for an auxiliary reed in order to guide the weft thread between the two sensor devices. This means a considerable saving in space and weight.

In addition a monitoring apparatus of this kind brings with it the advantage that the sensor device which is not mounted on the weaving sley can be used in a manner which will be described below for the monitoring, manipulation and where appropriate for the elimination of faulty weft threads, for example in the context of automatic procedures for the elimination of weft thread insertion faults. In known apparatuses an additional, thus a third sensor device, is as a rule necessary for this. In the monitoring apparatus in accordance with the invention such a third sensor device can be dispensed with, which is advantageous both from the point of view of the apparatus and the costs.

In a preferred embodiment a capture or receiving device which is firmly mounted on the weaving sley is provided for holding and/or stretching the weft thread, which comprises a capture or receiving nozzle and a capture or receiving tube which are arranged relative to one another in such a manner that the end of the weft thread can be deflected into the capture tube through charging the capture nozzle with the fluid. Through this measure it is ensured that the correctly inserted weft thread is held and stretched until its beating up and binding in through the change of shed. Through the deflection of the weft thread end there results an increase of the frictional force and thus of the holding force which acts on the weft thread.

In the case of weft threads which are in particular stiff in bending it is advantageous for the capture tube to open into the weft insertion direction at an acute angle, preferably at an angle of 30° to 70°. If the capture tube opens into the weft insertion direction at right angles there would be the danger that, in the case of stiff weft threads in particular, the impulse which is exerted on the end of the weft thread is too small to achieve a right-angled or even greater deflection.

Furthermore, in regard to the impulse transmission to the weft thread end, it is advantageous for the capture nozzle to be designed as a pressure nozzle and to be arranged in such a manner that the jet which is emitted by the capture nozzle extends in the same direction as the capture tube. This means that the exit direction of the capture nozzle aligns with the inlet region of the capture tube.

A further advantageous measure consists in providing a suction device for the weft thread or for parts thereof which is arranged on the receiving side to be stationary with respect to the machine frame and which comprises the other one of the sensor devices as a tube monitor. Providing the second sensor device in or at the suction device has the advantage that this sensor device is passed both in the case of correct weft insertions and in the context of eliminations of weft thread insertion faults by thread remnants, and a cleansing effect is thus achieved.

From the practical point of view it is preferred for the suction device to comprise an inlet funnel and a suction tube connected after it, with the inlet funnel facing the capture device and the tube monitor being arranged in the region of the suction tube. The inlet funnel can then be designed with respect to its lateral extension in such a manner that it covers over the entire amplitude of the oscillatory movement of the outlet of the weft insertion path, i.e. of the capture apparatus.

It has also proved advantageous to provide a flexible connection line which is connected on the one hand to the capture tube and on the other hand to an inlet which opens into the suction device, preferably into the suction tube.

In particular in regard to the manipulation of weft thread insertion faults and the removal of incorrectly inserted weft threads it is a preferred measure for the suction device to comprise a disposal nozzle which can be charged with the fluid and which is arranged directly ahead of the tube monitor when viewed in the insertion direction. This disposal nozzle, which is preferably designed as a pressure nozzle or blowing nozzle, has the advantage that a greater drawing force can be exerted on faulty weft threads which must be removed from the shed.

In particular when using an electrostatic tube monitor it is particularly advantageous to arrange the disposal nozzle at or in the suction tube in such a manner that the fluid jet which is emitted by the disposal nozzle extends obliquely to the axis of the suction tube. Through this measure the thread to be disposed of is deflected in such a manner that it gives off its charge better to the tube monitor. The measure is furthermore advantageous if the tube monitor includes an optical sensor because the cleaning action of the thread or thread remnant on the optical sensor is enhanced.

In accordance with a particularly advantageous variant, the disposal nozzle and/or the inlet is arranged asymmetrically with respect to the longitudinal axis of the suction tube. Through the asymmetrical alignment of the disposal nozzle and/or of the inlet the thread or thread remnant receives a twist and moves rotatingly along the inner wall of the suction tube. In this way the cleaning effect can be enhanced and, in the case of an electronic tube monitor, the charge transfer to the tube monitor can be improved further.

In a preferred embodiment the tube monitor therefore comprises an electrostatic sensor, and the disposal nozzle is arranged in such a manner that the fluid jet which is emitted by the disposal nozzle increases the static charge of the thread and deflects the thread in such a manner that it gives off its charge to the electrostatic sensor.

In accordance with a preferred variant the tube monitor includes an optical sensor and the inlet into the suction device is arranged such that during the normal operation the thread remnants R captured by the capture device continuously clean the optical sensor.

A further preferred measure is to provide means in order to vary the distance between the sensor device on the weaving sley (thus the weft thread monitor) and the tube monitor. Through this it becomes possible for example to vary the criteria for the monitoring of long weft thread insertions and to adapt them to the respective application.

The invention will be explained in the following in more detail with reference to exemplary embodiments and with reference to the drawings.

DESCRIPTION OF THE PREFERRED EMBODIMENTS

Figure 1:
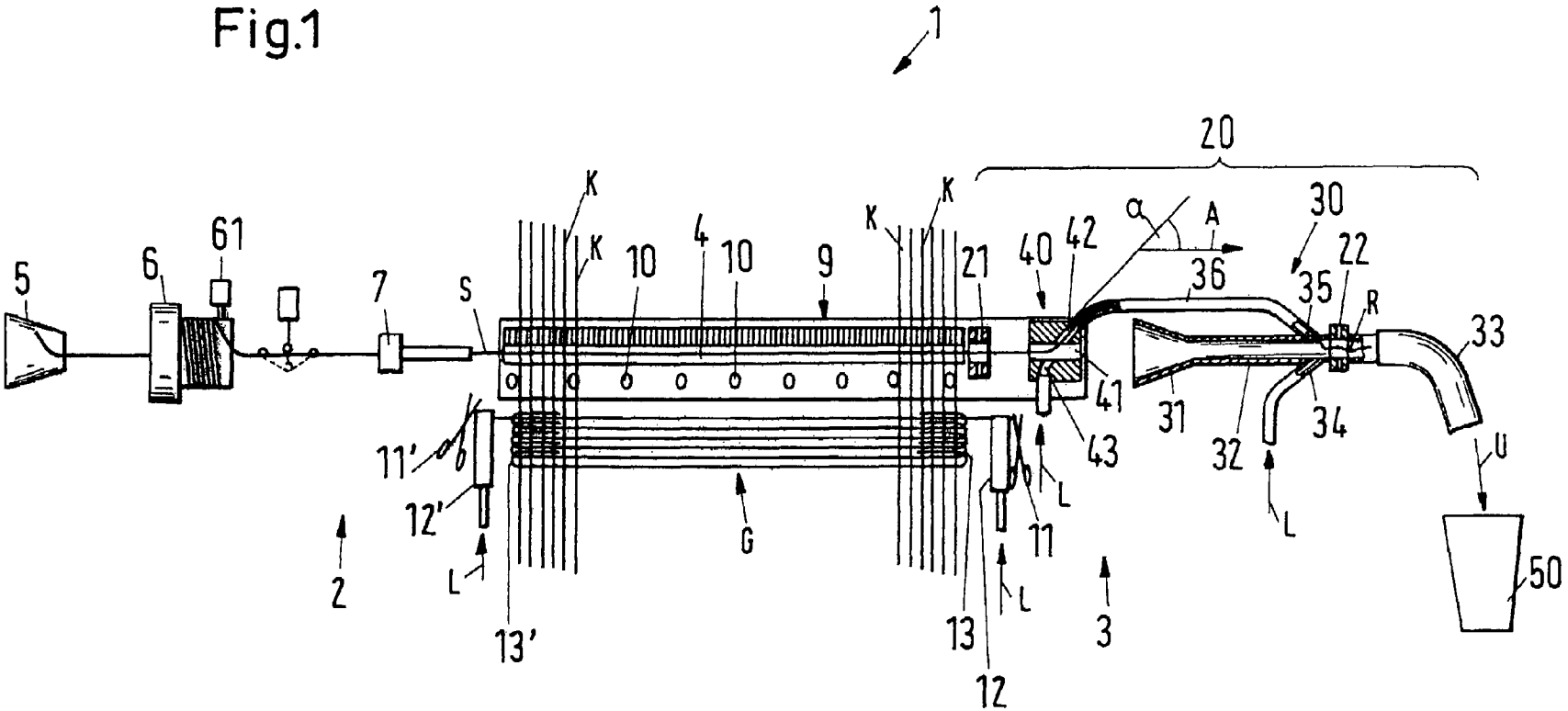
FIG. 1 shows essential parts of an exemplary embodiment of a jet weaving machine in accordance with the invention.

FIG. 1 shows in a schematic illustration essential parts of an exemplary embodiment of a jet weaving machine in accordance with the invention, especially an air jet weaving machine, which is designated in its entirety by the reference numeral 1. Components of the air jet weaving machine which are sufficiently known per se, such as the drive, warp beam, cloth draw off, electronic control and guidance devices etc., are not illustrated for the sake of better comprehensibility.

In the jet weaving machine 1 a weft thread S is inserted by means of a fluid, here air, from a weft insertion side 2 to a receiving side 3 along a weft insertion path 4. The weft insertion path 4 determines the weft insertion direction, which is indicated in FIG. 1 by the arrow A.

The jet weaving machine 1 comprises a thread bobbin 5, from which the weft thread S is drawn off by means of a non-illustrated winding apparatus and is deposited in the form of a plurality of windings onto a winding drum 6 as a thread store.

For the weft insertion a predeterminable thread length is drawn off from the winding drum 6 until a thread stopper 61 prevents a further drawing off. The weft thread S is accelerated by a main nozzle 7 which is fed with compressed air. The weft thread S is inserted by the main nozzle 7 along the weft insertion path 4 through the open shed which is formed by the warp threads K. A plurality of auxiliary or relay nozzles 10, which assist the insertion of the weft thread S through the shed and guide the weft thread S, are usually also arranged along the weft insertion path 4. After completion of the weft insertion a weaving sley 9 beats up the weft thread S to the cloth G. Then a change of shed takes place, which means that the warp threads K are crossed, so that the inserted weft thread S is bound in into the cloth G over the entire weaving width. Then the just inserted weft thread S is severed by a severing device 11 on the receiving side 3 and by a further severing device 11' on the weft insertion side 2 so that a new thread beginning is ready for the next weft insertion.

Selvedge tucking devices 12' and 12 respectively can also be provided at the weft insertion and/or receiving side 2 and/or 3 respectively which bend the ends of the inserted weft thread S around after its severing and after completion of the change of shed, as is schematically shown in FIG. 1. In this way proper cloth edges 13, 13' can be produced. The selvedge tucking devices 12', 12 can be designed as air selvedge tucking devices which hold and bend the thread ends around by means of air. This is indicated by the arrows L at the selvedge tucking devices 12', 12.

In accordance with the invention a monitoring apparatus 20 is provided at the receiving side 3 and serves for the monitoring and manipulation of the weft thread tips or ends respectively at the receiving side. The monitoring apparatus 20 can also serve for the monitoring and manipulation of faulty weft threads and their elimination.

The monitoring apparatus 20 comprises two sensor devices 21, 22 for detecting the weft thread S or parts of the weft thread S respectively. In accordance with the invention, only exactly one of these two sensor devices 21, 22 on the receiving side 3, namely the sensor device 21, which is designated in the following as a weft thread monitor, is firmly mounted on the weaving sley 9, so that the sensor device 21 is stationary with respect to the weaving sley 9 and participates in its oscillatory movement.

The second sensor device 22, which will be designated in the following as the tube monitor 22, is integrated in a manner which will be explained in more detail below into a suction device 30, which is a constituent of the monitoring apparatus 20 and serves for the sucking away of thread pieces or thread remnants.

In the exemplary embodiment illustrated here the weft thread monitor 21 is arranged directly at the receiving side end of the weft insertion path 4 and detects the weft thread end as soon as it leaves the shed at the end of the weft insertion path 4. Any sensor which is known per se and by means of which the weft thread can be detected, for example an electrostatic or an optical sensor, is suitable as a weft thread monitor 21.

The monitoring apparatus 20 further comprises a capture device 40 which is firmly mounted on the weaving sley 9 after the weft thread monitor 21 when viewed in the weft insertion direction and as a consequence moves synchronously with the weaving sley 9. The capture device 40 serves for holding and stretching the inserted weft thread and comprises a through-going passage 41 which extends in the weft insertion direction A, a capture tube 42 and a capture nozzle 43. The capture device 40 is mounted on the weaving sley 9 in such a manner that the through-going passage 41 aligns with the weft insertion path 4, which means that the passage 41 extends in the prolongation of the weft insertion path 4. The capture nozzle 43 and the capture tube 42 are arranged relative to one another in such a manner that the end of the inserted weft thread can be deflected into the capture tube 42 through charging the capture nozzle 43 with the fluid—here the air.

In the case of stiffer weft threads S in particular it is advantageous for the capture tube 42 to be arranged in such a manner that it opens obliquely into the passage 41 at an acute angle $\alpha$ and thus in the weft insertion direction. On the one hand it is desirable to deflect the inserted weft thread S which is to be held by the capture device 40 away from the weft insertion direction A in order thereby to be able to exert a greater holding force on the weft thread through the increase in the frictional force. On the other hand, it is difficult or disadvantageous in particular in the case of weft threads which are stiff in bending to deflect the weft thread S in the capture device 40 at a right angle or even at an obtuse angle away from the weft insertion direction A. Practice has shown that in the case of stiff weft threads in particular the angle $\alpha$ preferably amounts to 30° to 70°.

The capture nozzle 43 is preferably a pressure nozzle or blowing nozzle which is charged with compressed air, as indicated by the arrow L in FIG. 1. The capture nozzle 43 discharges into the passage 41 and is oriented in such a manner that the air jet which is emitted by the capture nozzle 43 extends substantially in the same direction as the capture tube 42 and the opening of the capture tube 42 aims into the passage 41.

The monitoring apparatus 20 further comprises a suction device 30 which is arranged stationary with respect to the machine frame of the jet weaving machine 1. The suction device 30 is mounted on the receiving side 3 substantially in a prolongation of the weft insertion path 4 outside the weaving sley 9. The suction device 30 comprises an inlet funnel 31 and a suction tube 32 which is connected after it. The inlet funnel 31 is arranged at the same height level as the receiving side end of the weft insertion path 4 and indeed in such a manner that it opens in the direction of the capture device 40. With respect to its lateral extension the inlet funnel 31 is preferably designed in such a manner that it covers over the entire amplitude of the oscillatory movement of the receiving side end of the weft insertion path 4. During operation a rectilinear prolongation of the weft insertion path 4 thus always moves within the inlet funnel 31.

The inlet funnel 31 merges into the suction tube 32, which extends in the weft insertion direction A. The second sensor device 22, namely the tube monitor 22, is integrated into the suction tube 32. In accordance with the illustration the tube monitor 22 is arranged in the end region of the suction tube 31 which faces away from the inlet funnel 31. Any sensor apparatus which is known per se and which is suitable for detecting the weft thread or parts of the weft thread, in particular electrostatic or optical sensors, is suitable as a tube monitor 22.

A flexible disposal line 33, through which sucked away threads or thread parts arrive at a disposal container 50, is connected to the suction tube 32.

As symbolically indicated by the arrow U, a depression for sucking away the thread parts is produced in the suction device 30 during operation.

In a preferred embodiment the suction device 30 comprises a disposal nozzle 34, which discharges into the suction tube 32 preferably directly ahead of the tube monitor 22 when seen in the weft insertion direction. The disposal nozzle 34 is designed as a blowing nozzle and can be charged with air, as indicated by the arrow L in FIG. 1. The disposal nozzle 34 is advantageously arranged in such a manner that the air jet which is emitted by it extends obliquely to the axis of the suction tube. Through this the disposal nozzle 34 blows a thread which passes it obliquely in the direction towards the tube monitor 22. In the case of an electrostatic tube monitor 22 there results from this a significantly improved charge transfer from the thread to the tube monitor 22, through which the detection is improved.

It has been shown that a charging of the thread with compressed air leads to an increase in its static charge. Therefore it is advantageous to arrange the disposal nozzle 34 directly ahead of the tube monitor 22, because in this manner the static charge of the thread to be detected is increased through the compressed air impulse directly ahead of the tube monitor.

Directly ahead of the tube monitor 22 an inlet 35 discharges into the suction tube 32. The inlet 35 discharges obliquely into the suction tube 32 at about the same axial position of the suction tube 32 at which the disposal nozzle 34 also discharges. In the embodiment illustrated here the disposal nozzle 34 and the inlet 35 are preferably substantially symmetrically arranged with respect to the axis of the suction tube 32.

A flexible connection line 36 connects the outlet of the capture tube 42 of the capture device 40 to the inlet 35 of the suction device 30.

During the operation of the jet weaving machine the monitoring apparatus 20 works as follows:

In normal operation a predetermined thread length of the weft thread S is accelerated by the main nozzle 7 from the winding drum and inserted through the open shed along the weft insertion path 4. When leaving the shed the end of the weft thread S passes over to the receiving side of the weft thread monitor 21 and is detected by the latter. Then the end of the weft thread arrives into the passage 41 of the capture device 40. There the capture nozzle 43 blows the end of the weft thread S by means of an air jet into the capture tube 42, where it is held. If the weft thread S has the correct length, then after the completion of the insertion process its end is located at some position between the entrance into the capture device 40 and the tube monitor 22, as is illustrated in an exemplary manner in FIG. 1 for the weft thread S. In the further course of the weaving cycle the weaving sley 9 beats up the inserted weft thread S to the cloth edge and the change of shed takes place, through which the weft thread is bound in into the cloth over the entire weaving width.

During the beating up by the weaving sley 9 the weft thread S is introduced on the weft insertion side 2 and on the receiving side 3 in each case into the selvedge tucking devices 12' and 12 respectively.

After the change of shed the inserted and now bound in weft thread S is severed on the receiving side 3 and on the weft insertion side 2 by means of the severing device 11 or 11' respectively. The receiving side thread remnant R is sucked away and enters through the flexible connection line 36 and the inlet 35 into the suction tube 32, passes—as illustrated in FIG. 1 —the tube monitor 22, triggers a signal there and finally arrives via the disposal line 33 at the disposal container 50.

It is possible that the thread end of a correctly inserted weft thread does not arrive in the capture tube 42 in spite of the activation of the capture nozzle 43, but rather is stretched in a straight line in the passage 41. After the receiving side severing of a weft thread of this kind the weft thread remnant R is sucked away by the inlet funnel 31 and thus arrives past the tube monitor 22 into the disposal line 33. This usually does not lead to an error message.

After completion of the change of shed the thread ends which are located in the selvedge tucking devices 12, 12' are bent around and inserted into the newly opened shed.

During the weaving operation the correctness of the weft insertion is checked using the two sensor devices 21, 22. For this the sensor devices are connected in a signal transmitting manner to a non-illustrated evaluation and control unit.

In the case of a correct weft insertion the weft thread end must pass the weft thread monitor 21 within a known first time interval—in relation to the weaving cycle. After the severing the thread remnant R must pass the tube monitor during a known second time interval—in relation to the weaving cycle. Both time intervals correspond to an angular interval of the main shaft of the weaving machine. In this connection it is thus irrelevant whether one speaks of a time interval or of an angular interval.

As a criterion for a correct weft insertion for example the following is used: During the first time interval the weft thread monitor 21 has detected a thread and outside the second time interval the tube monitor 22 has detected no thread.

The monitoring apparatus 20 operates in this manner during a correct weft insertion. A substantial advantage with respect to known apparatuses is that even in each correct weft insertion the thread remnant R passes the tube monitor 22. Through this a contamination of the tube monitor 22 is effectively counteracted, because the thread remnants R continually cleanse the tube monitor.

As long as the weft insertions take place without error, the disposal nozzle 34 is usually inactive.

In the following the detection of possible errors in the weft insertion will now be briefly explained in a non-exhaustive manner:

In the case of a so-called long weft thread insertion too much thread is drawn off from the winding drum, e.g. one winding too many. The weft thread monitor 21 indeed still gives the signal that the weft thread end has passed it correctly within the first time interval, but the tube monitor 22 reports an arrival of the weft thread outside the second interval. Since in the case of a long weft thread insertion of this kind both sensors emit a signal in an overlapping manner, the long weft thread insertion is simple to detect. In general a long weft thread insertion does not lead to a stopping of the weaving machine. The thread length can however be changed for the next weft insertions.

Furthermore, it is possible that a piece of the weft thread is torn off. The latter then flies through the passage 41 of the capture device 40 and is sucked away by the inlet funnel 41 of the suction device. Depending on where or when the weft thread tears, the weft thread monitor 21 and/or the tube monitor 22 then registers that the arrival of a thread was detected outside the first and/or second time interval.

In a so-called stop shot or stoppage weft insertion the weft thread breaks during the braking. In a case of this kind the weft thread monitor 21 usually still registers the correct arrival of the weft thread end in the first time interval, but the tube monitor registers the arrival of a thread outside the second time interval, namely too early.

If the weft thread monitor 21 does not register an arrival of a weft thread up until the end of the first time interval, then an error in the weft insertion has certainly arisen, for example the weft thread can have been snagged between the warp threads.

Depending on the error which has arisen in the weft insertion, methods are known for remedying the error which has arisen or to eliminate the faulty weft thread respectively by means of automatic procedures. The monitoring apparatus 20 of the jet weaving machine 1 in accordance with the invention is also suitable for such automatic procedures for the elimination of weft insertion errors. In the following an automatic procedure of this kind will be explained in an exemplary manner with reference to FIG. 2.

It will be assumed that the weft thread monitor 21 has not detected the arrival of the weft thread S up until the end of the first time interval. The weft thread has become snagged in the shed.

Figure 2:
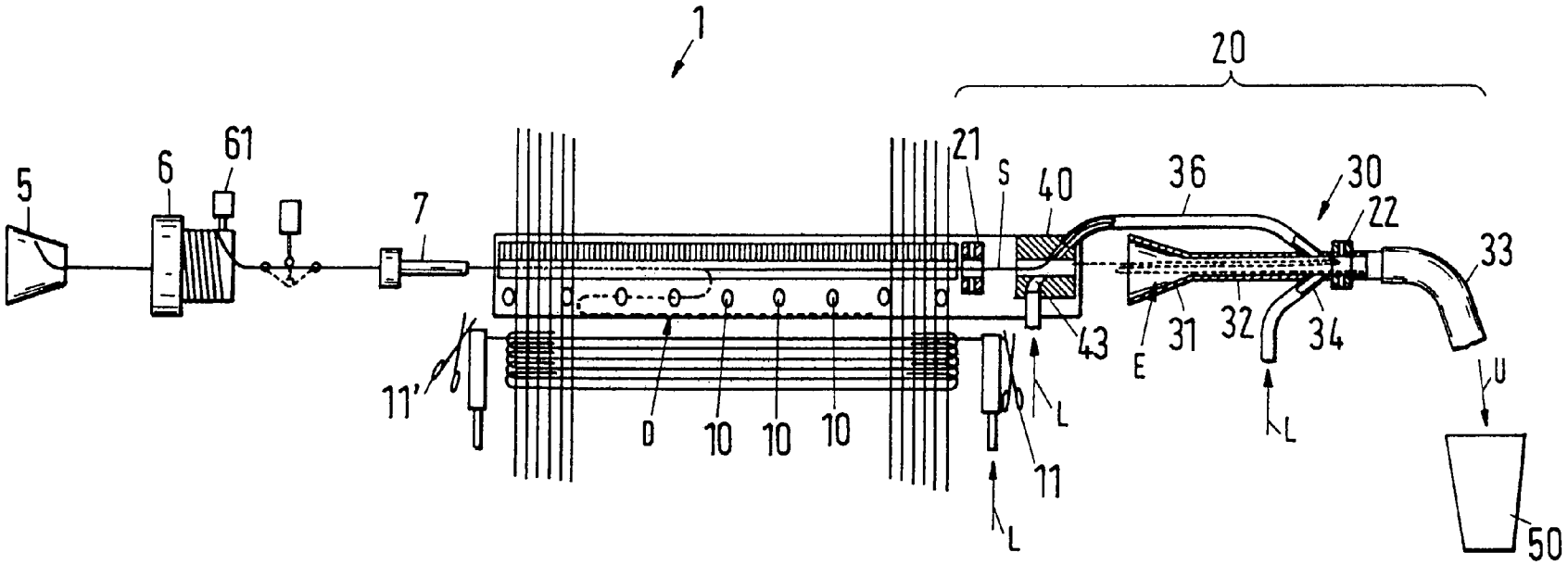
FIG. 2 shows a variant for the monitoring apparatus.

The weft thread monitor 21 does not detect the arrival of a weft thread end. The weaving machine is braked to a stop. Admittedly no beating up takes place as a rule, but the severing devices 11, 11' are deactivated so that no severing, in particular at the weft insertion side, of the incorrectly inserted weft thread S takes place. The shed is opened. Now a predetermined thread length is released by the thread stopper 61 on the winding drum 6, for example one or two windings. This thread length is blown as a loop D or a double loop respectively through the shed. The double loop D is illustrated in chain-dotted lines in FIG. 2. Through a corresponding activation of the relay nozzles 10 a traveling field is produced in the shed so that the loop travels through the shed and in so doing effects a release of the beat up faulty weft thread. The capture nozzle 43 of the capture device 40 is not activated. Thus the weft thread arrives through the inlet funnel 31 into the region of the tube monitor 22 into the position which is designated by E in FIG. 2. The tube monitor 22 detects the arrival of the weft thread. The disposal nozzle 34 is activated and charges the weft thread with a compressed air jet. The weft thread is severed at the weft insertion side by means of the severing device 11'. The disposal nozzle 34 generates an additional drawing force, which helps to release the incorrectly inserted weft thread from the shed. The successful completion of the elimination of the weft insertion error can be recognized in that the tube monitor 22 no longer detects a thread. Then the faulty weft thread is sucked away or blown out into the disposal container 50 in its entirety. The weaving process can be resumed. For comparison FIG. 2 shows the position of a correctly inserted weft thread S as a continuous line.

If the tube monitor 22 operates in accordance with an electrostatic principle, the disposal nozzle 34, in addition to the function of the releasing and the drawing out of the incorrectly inserted weft thread, also receives the function of effecting through the air jet which is emitted by it an amplification of the static charge of the thread, so that the latter can be better detected. Furthermore, the air jet, which emerges obliquely with respect to the weft insertion direction A, deflects the thread to be disposed of in the direction of the periphery of the suction tube 32, so that the thread can more effectively transfer its charge to the tube monitor.

The monitoring apparatus 20 of the jet weaving machine 1 in accordance with the invention has the advantage that the tube monitor 22 is used both in normal weaving operation and in procedures for the elimination of weft insertion errors. Thus in comparison with known apparatuses no additional sensor is necessary for the elimination of weft insertion errors. In this way one sensor can be saved. Furthermore, the tube monitor 22 is passed by a thread remnant R during each weft insertion. This has a continual cleansing effect as a consequence because the thread remnants R remove contaminations of the tube monitor 22. This increases the reliability of the sensor device and thus also the reliability of the monitoring.

Figure 3:
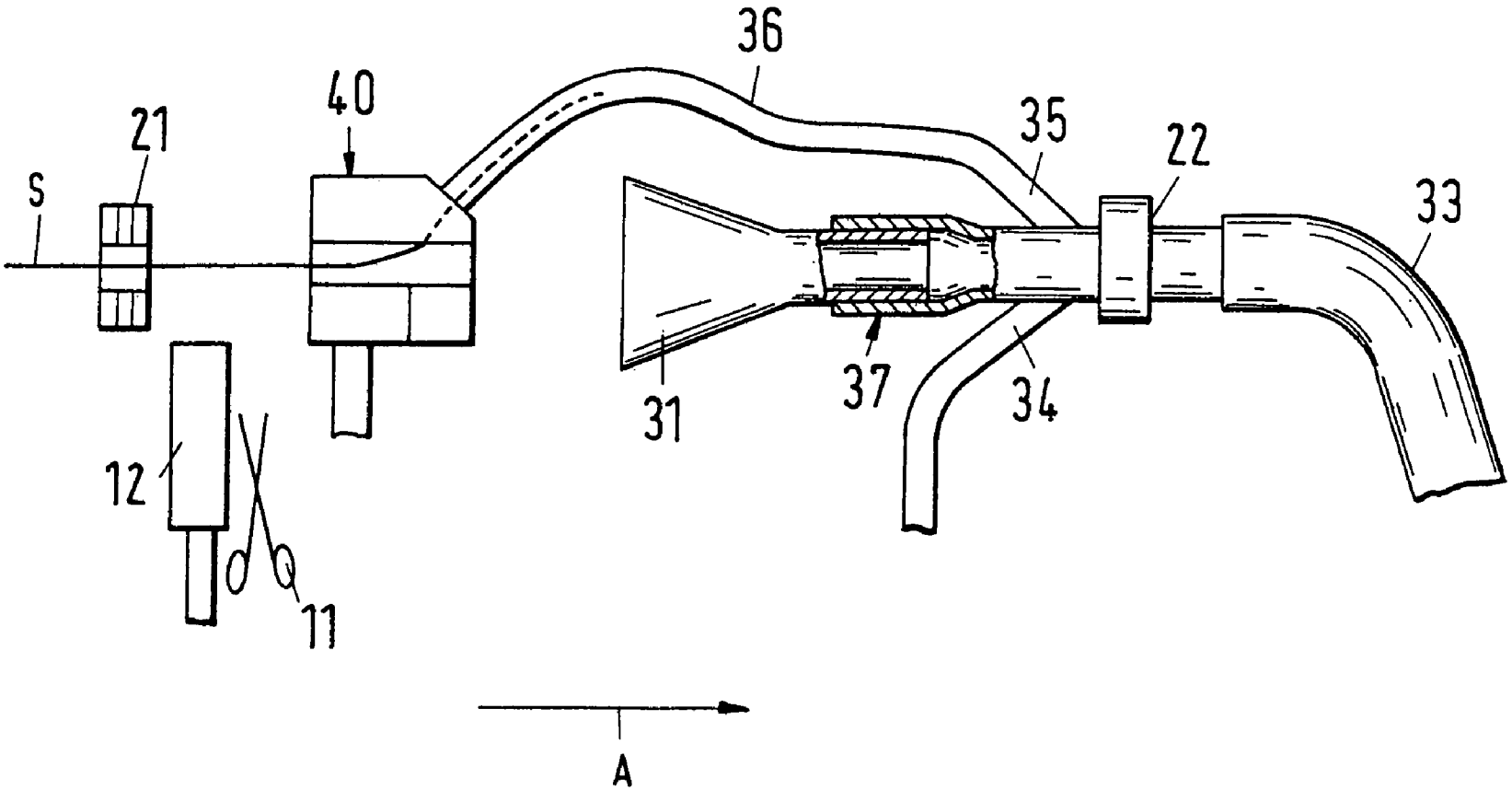
FIG. 3 is a representation illustrating the removal of a weft thread.

FIG. 3 shows a variant for the monitoring apparatus 20. The reference symbols have the same significance, which was already explained in connection with FIG. 1. The variant which is illustrated in FIG. 3 differs in that means are provided in order to vary the distance between the sensor device on the weaving sley, i.e. the weft thread monitor 21, and the tube monitor 22. These means comprise for example a clutch sleeve or sliding sleeve 37 which is arranged in such a manner that the inlet funnel 31 can be displaced relative to the tube monitor 22 in the weft insertion direction A. The connection line 36 is adaptable with respect to its length. Thus the distance between the weft thread monitor 21 and the tube monitor 22 is variable. Through the varying of this distance it can for example be determined how long a weft thread may be at the maximum before it is adjudged or detected to be a long weft thread insertion respectively.

Figure 4:
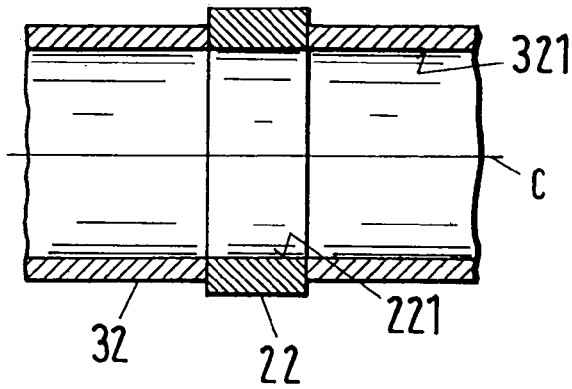
FIG. 4 is a longitudinal section through a suction tube with a tube monitor.

FIG. 4 shows a longitudinal section through the suction tube 32 in the region of the tube monitor 22. The longitudinal axis of the suction tube 32 is designated by C. The inner contour 221 of the tube monitor 22 is designed here such that it is made flush with respect to the inner wall 321 of the suction tube 32. Naturally other embodiments are also possible in this regard. Thus the inner contour 221 can also be made protruding or receding with respect to the inner wall 321. Besides the illustrated substantially cylindrical shape of the inner contour 321, concave or convex designs are also possible.

In the following, two particularly preferred variants for the suction device 30 will be explained with reference to FIGS. 5 and 6. Here only the differences from the previously described embodiment will be discussed. In other respects the explanations of the exemplary embodiments which are illustrated in FIGS. 1–4 apply in an analogous manner.

Figure 5:
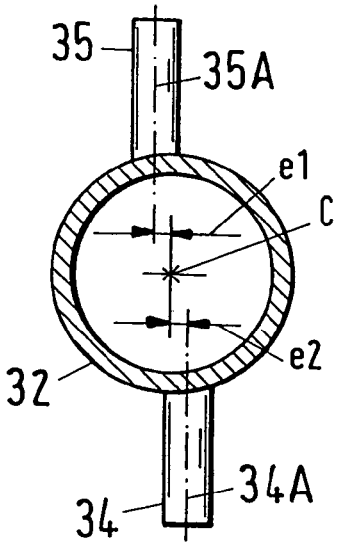
FIG. 5 is a respective cross-section through the suction tube for variants of the suction device.
Figure 6:
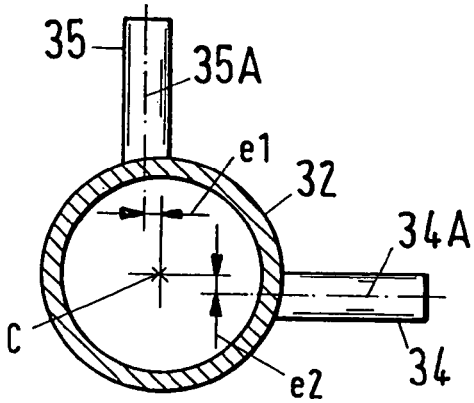
FIG. 6 is a cross-section through the suction tube in another variant of the device.

FIGS. 5 and 6 each show a cross-section through the suction tube 32, the longitudinal axis of which is again designated by C. In these two variants the disposal nozzle 34 and the inlet 35 are arranged asymmetrically with respect to the longitudinal axis C of the suction tube. This means that the axis 35A of the inlet 35 and the axis 34A of the disposal nozzle 34 lie adjacent to the longitudinal axis C of the suction tube 32 by an amount e1 and e2 respectively. The axes 35A and 34A thus do not intersect the longitudinal axis of the suction tube.

In the variant in accordance with FIG. 5 the inlet 35 and the mouth of the disposal nozzle 34 are offset with respect to the peripheral direction of the suction tube by about 180°, in the variant in accordance with FIG. 6 by about 90°.

In the variants which are illustrated in FIGS. 5 and 6 both the inlet 35 and the disposal nozzle 34 are in each case asymmetrically arranged. Naturally variants are also possible in which either only the disposal nozzle 34 or only the inlet 35 is asymmetrically arranged.

Through the asymmetrical arrangement of the disposal nozzle 34 and/or of the inlet 35 the thread or the thread remnant receives a spin and rotates along the inner wall of the suction tube 32.

Through the oblique and asymmetrical arrangement of the inlet 35 the cleansing effect already explained above is further increased. The thread piece which comes into the suction tube through the inlet 35 receives a spin; it rotates along the inner wall of the suction tube 32 and in so doing cleanses the tube monitor 22.

In the case of an electrostatic tube monitor 22 and with the asymmetrical arrangement of the inlet 35 the static charge of the thread is further increased through the twirling and the charge transfer to the tube monitor 22 is also improved.

The invention claimed is:

1. Jet weaving machine in which a weft thread can be inserted by means of a fluid from a weft insertion side to a receiving side, including a weaving sley, along which a weft insertion path extends, which determines a weft insertion direction, and including a monitoring apparatus which is arranged at the receiving side and which comprises first and second sensor devices for detecting the weft thread or parts of the weft thread, wherein only the first sensor device is fixedly mounted on the weaving sley for movement with the sley and the second sensor device is mounted so that it does not move with the sley, and a capture device which is fixedly arranged on the weaving sley for holding and/or stretching the weft thread and which comprises a capture nozzle and a capture tube, the capture nozzle being designed as a pressure nozzle and being arranged in such a manner that the jet emitted by the capture nozzle extends in the same direction as the capture tube.

2. Jet weaving machine in accordance with claim 1, wherein the capture device and the capture tube are arranged with respect to one another in such a manner that the end of the weft thread can be deflected into the capture tube through charging the capture nozzle with the fluid.

3. Jet weaving machine in accordance with claim 1, with the capture tube opening into the weft insertion direction at an acute angle.

4. Jet weaving machine in accordance with claim 1, including a suction device for the weft thread or for parts thereof which is arranged on the receiving side stationary with respect to the machine frame and which comprises the second sensor device formed as a tube monitor.

5. Jet weaving machine in which a weft thread can be inserted by means of a fluid from a weft insertion side to a receiving side, including a weaving sley, along which a weft insertion path extends, which determines a weft insertion direction, and including a monitoring apparatus which is arranged at the receiving side and which comprises first and second sensor devices for detecting the weft thread or parts of the weft thread, wherein only the first sensor device is fixedly mounted on the weaving sley for movement with the sley and the second sensor device is mounted so that it does not move with the sley, and a suction device for the weft thread or for parts thereof which is arranged on the receiving side stationary with respect to the machine frame and which comprises the second sensor device formed as a tube monitor, and in which the suction device comprises an inlet funnel and a suction tube which follows it, with the inlet funnel facing the capture device, and in which the tube monitor is arranged in the region of the suction tube.

6. Jet weaving machine in accordance with claim 4, including a flexible connection line which is connected at the one end to the capture tube and at the other end to an inlet which opens into the suction device.

7. Jet weaving machine in which a weft thread can be inserted by means of a fluid from a weft insertion side to a receiving side, including a weaving sley, along which a weft insertion path extends, which determines a weft insertion direction, and including a monitoring apparatus which is arranged at the receiving side and which comprises first and second sensor devices for detecting the weft thread or parts of the weft thread, wherein only the first sensor device is fixedly mounted on the weaving sley for movement with the sley and the second sensor device is mounted so that it does not move with the sley, and a suction device for the weft thread or for parts thereof which is arranged on the receiving side stationary with respect to the machine frame and which comprises the second sensor device formed as a tube monitor, and in which the suction device comprises a disposal nozzle which can be charged with the fluid and which is arranged directly ahead of the tube monitor when viewed in the weft insertion direction.

8. Jet weaving machine in accordance with claim 7, in which the disposal nozzle is arranged at or in the suction tube in such a manner that the jet of the fluid which is emitted by the disposal nozzle extends obliquely with respect to the axis of the suction tube.

9. Jet weaving machine in accordance with claim 7, in which the disposal nozzle and/or the inlet is asymmetrically arranged with respect to a longitudinal axis of the suction tube.

10. Jet weaving machine in accordance with claim 7, in which the tube monitor comprises an electrostatic sensor and in which the disposal nozzle is arranged in such a manner that the jet of the fluid which is emitted by the disposal nozzle increases the static charge of the thread and deflects the thread in such a manner that it gives off its charge to the electrostatic sensor.

11. Jet weaving machine in accordance with claim 7, in which the tube monitor includes an optical sensor and in which the inlet into the suction device is arranged such that during the normal operation the thread remnants captured by the capture device continuously clean the optical sensor.

12. Jet weaving machine in accordance with claim 1, in which means are provided in order to vary the distance between the sensor device on the weaving sley and the tube monitor.

13. Jet weaving machine in accordance with claim 6, wherein the suction device comprises a suction tube.

14. Jet weaving machine in which a weft thread can be inserted by means of a fluid from a weft insertion side to a receiving side, including a weaving sley, along which a weft insertion path extends, which determines a weft insertion direction, and including a monitoring apparatus which is arranged at the receiving side and which comprises two sensor devices for detecting the weft thread or parts of the weft thread, characterized in that just one of the sensor devices is fixedly mounted on the weaving sley, wherein the capture nozzle is designed as a pressure nozzle and arranged in such a manner that the jet emitted by the capture nozzle extends in the same direction as the capture tube, and including a flexible connection line which is connected at the one end to the capture tube and at the other end to an inlet which opens into the suction device.

15. Jet weaving machine in accordance with claim 3, with the capture tube open into the weft insertion direction at an angle of 30° to 70°.

16. Jet weaving machine in accordance with claim 5, including a flexible connection line which is connected at the one end to the capture tube and at the other end to an inlet which opens into the suction device.

* * * * *